US007740320B2

(12) United States Patent
Chiang

(10) Patent No.: US 7,740,320 B2
(45) Date of Patent: Jun. 22, 2010

(54) CHAIR HAVING GROOVES IN EACH ARM FOR RECEIVING A SHEET OF FABRIC AS A SEAT

(76) Inventor: Ming Chiang, 206 Woodbury Rd., Woodbury, NY (US) 11797

( * ) Notice: Subject to any disclaimer, the term of this patent is extended or adjusted under 35 U.S.C. 154(b) by 0 days.

(21) Appl. No.: 12/265,226

(22) Filed: Nov. 5, 2008

(65) Prior Publication Data

US 2010/0109414 A1 May 6, 2010

(51) Int. Cl.
*A47C 7/02* (2006.01)
*A47C 7/22* (2006.01)

(52) U.S. Cl. ..... 297/440.15; 297/440.17; 297/440.2; 297/440.21; 297/440.22; 297/440.24; 297/451.8; 297/452.13; 297/452.2; 297/452.56

(58) Field of Classification Search ..... 297/440.15, 297/440.16, 440.17, 440.18, 440.2, 440.21, 297/440.22, 452.13, 452.56, 440.24, 451.58, 297/452.2, 451.8
See application file for complete search history.

(56) References Cited

U.S. PATENT DOCUMENTS 2,325,270 A * 7/1943 Oermann ..... 297/440.15 X
2,512,353 A * 6/1950 Magaldino et al. .. 297/440.24 X
3,024,068 A * 3/1962 Eames ..... 297/452.13
3,041,109 A * 6/1962 Eames et al. ..... 297/440.15 X
3,115,368 A * 12/1963 Springer et al. ..... 297/440.17 X
3,640,576 A * 2/1972 Morrison et al. ..... 297/440.11
3,822,079 A * 7/1974 Probber ..... 297/440.21 X
4,062,589 A * 12/1977 Klein et al. ..... 297/440.15 X
4,318,556 A * 3/1982 Rowland ..... 297/440.2 X
4,522,444 A * 6/1985 Pollock ..... 297/440.24 X
4,848,843 A * 7/1989 Gibbs ..... 297/440.22
5,318,348 A * 6/1994 Hess ..... 297/440.11
5,338,091 A * 8/1994 Miller ..... 297/452.56 X
5,507,563 A * 4/1996 Arthur, Jr. ..... 297/452.13 X
5,626,394 A * 5/1997 Perry ..... 297/440.24 X
5,630,643 A * 5/1997 Scholten et al. ..... 297/440.15 X
5,649,742 A * 7/1997 Liu ..... 297/452.2
5,716,101 A * 2/1998 Frinier et al. ..... 297/440.22
5,746,479 A * 5/1998 Bodnar ..... 297/440.16 X
5,762,403 A * 6/1998 Robinson ..... 297/452.13 X
5,769,500 A * 6/1998 Holbrook ..... 297/452.63 X
5,911,478 A * 6/1999 Goodman ..... 297/452.13 X
5,961,184 A * 10/1999 Balderi et al. ..... 297/440.15 X
5,988,755 A * 11/1999 Fastelli et al. ..... 297/440.24
6,293,624 B1 * 9/2001 Gaylord et al. ..... 297/440.11

(Continued)

FOREIGN PATENT DOCUMENTS

EP 241628 A1 * 10/1987 ..... 297/440.16

*Primary Examiner*—Rodney B White
(74) *Attorney, Agent, or Firm*—F. Chau & Associates, LLC

(57) ABSTRACT

A chair is presented that includes a pair of chair arms, two pairs of chair legs, and a sheet of fabric. Each chair arm has a concave shape and a concave groove extending along the entire length of a concave surface of the chair arm. Each pair of chair legs is affixed to a bottom surface of each chair arm opposite the groove. The sheet of fabric has a pair of flexible rods. Each rod is affixed to the fabric and is substantially parallel to one another. The sheet of fabric is affixed to the chair by threading each of the rods through a different one of the corresponding grooves.

18 Claims, 9 Drawing Sheets

U.S. PATENT DOCUMENTS 6,370,714 B1 * 4/2002 Elzenbeck ..... 5/110
6,523,904 B1 * 2/2003 Vanderminden ..... 297/452.63
6,560,827 B1 * 5/2003 Gross ..... 297/440.11 X
6,585,323 B2 * 7/2003 Gaylord et al. ..... 297/452.13 X
6,695,411 B2 * 2/2004 Leng et al. ..... 297/440.16 X
6,702,389 B2 * 3/2004 Hall et al. ..... 297/452.56
6,739,671 B2 * 5/2004 De Maina ..... 297/440.2 X
6,779,849 B1 * 8/2004 Harper et al. ..... 297/452.13
6,863,348 B1 * 3/2005 Cvek ..... 297/440.2
7,568,768 B1 * 8/2009 Tsai ..... 297/452.56 X
2002/0084687 A1 * 7/2002 Gaylord et al. ..... 297/452.13
2003/0160495 A1 * 8/2003 Tarnay et al. ..... 297/452.13

* cited by examiner

CHAIR HAVING GROOVES IN EACH ARM FOR RECEIVING A SHEET OF FABRIC AS A SEAT

BACKGROUND OF THE INVENTION

1. Technical Field

The present disclosure relates to a chair, and more particularly to a chair having grooves in each arm for receiving a sheet of fabric to be used as a seat of the chair.

2. Discussion of Related Art

Manufacturers of chairs are constantly seeking to develop new product designs and new ideas for reducing manufacturing costs and assembly time. Chairs are typically massed produced in many attractive and distinctive designs and color combinations. Typical of these designs are the casual outdoor furniture products made from welded tubular aluminum, steel, or other metal framing with a powder coast finish.

However, it can be uncomfortable to sit in metal outdoor patio furniture for an extended period of time, unless the seating surfaces are designed properly. Manufacturers of outdoor furniture have added cushions to make them more comfortable. However, cushions can be inconvenient because they must be stored indoors to protect them from the elements such as rain and prolonged sun exposure. In addition, once removed, the cushions require storage space.

Manufacturers have looked for ways to upholster patio chairs with a material that is comfortable, but which does require its removal and storage when not in use. For example, a woven vinyl coated polyester fabric provides a comfortable seating surface, while being water resistant.

The patio furniture industry has used a method for attaching a woven vinyl coated polyester fabric to a metal frame structure. This technique includes the step of folding over the edges of the fabric and stitching the edge down to form a loop along opposite edges of the fabric. These loops are then attached to a flat seat rail by inserting them in a groove along the surface of the hollow seat rail, such that the loop extends through the center of a hollow channel in the seat rail. A flexible plastic rod having a diameter larger than the width of the groove is threaded through the channel in the loop within the seat rail, thereby securing the fabric to the seat rail along its entire length. The flat seat rails are then bolted to the chair frame by suitable hardware passing through the seat rail and into the chair frame. This attachment method for securing the seat rail to the chair frame increases production costs by requiring threaded holes to be located in the chair frame as well as reinforced locations to withstand the stresses concentrated at the connection points between the seat rail and the chair frame. Further, while the fabric does provide some cushioning, since the seat rails are attached to the chair frame, some part of an occupant's legs will typically rest uncomfortably on a portion of chair's frame and/or the seat rails.

Consequently, there exists a need for a chair with an attached elastic fabric, which reduces manufacturing costs and improves comfort.

SUMMARY OF THE INVENTION

An exemplary embodiment of the present invention includes a chair having a pair of chair arms, two pairs of chair legs, and a sheet of fabric. Each chair arm has a concave shape and a concave groove extending along the entire length of a concave surface of the chair arm. Each pair of chair legs is affixed to a bottom surface of each chair arm opposite the groove. The sheet of fabric has a pair of flexible rods. Each rod is affixed to the fabric and is substantially parallel to one another. The sheet of fabric is affixed to the chair by threading each of the rods through a different one of the corresponding grooves.

The chair legs and chair arms may be made of metal. The chair arms and legs may be hollow tubes. The depth of each groove along the entire length of each chair arm may be substantially the same. The fabric may be an elastic material. The sheet of fabric may be stitched to separate the sheet into a chair backing section and a chair seat section. Each the chair arms may include a pair of chair arm extensions that are configured to detachably connect to each pair of the chair legs. Each chair arm extension may be detachably connected to each chair leg using a button. The button may be attached to an end of the chair arm extension or the chair leg, and the end of chair arm or chair leg may include a corresponding hole to receive the button. The chair legs of each pair of chair legs may be connected to one another by a supporting rod. The width of the fabric may be configured such that an occupant of the chair rests lower than the chair arms and higher than the supporting rods. Each supporting rods may be detachably connected to its respective chair legs. The chair may further include a plurality of caps, where each cap includes a layer with a concave shape that is configured to fit in each chair arm end below the corresponding groove. The chair arms may be substantially parallel to one another. The diameter of each rod may be larger than the width of each groove.

An exemplary embodiment of the present invention includes a chair having a pair of chair arms, two pairs of chair arm extensions, two pairs of chair legs, an elastic sheet of fabric, and two flexible rods. Each chair arm has an upper concave portion and a lower substantially straight portion. Each chair arm has a substantially equal-depth groove extending along an upper surface of the chair arm. Each chair arm extension of the first pair is affixed to a bottom surface of a different chair arm in the upper concave portion and each chair arm extension of the second pair is affixed to a bottom surface of a different chair arm in the lower substantially straight portion. One pair of the chair legs is affixed to a first pair of the extensions and a second pair of the chair legs attached to the other pair of extensions. Each rod is affixed to the fabric and each rod is substantially in parallel to one another. The sheet of fabric is affixed to the chair by threading each of the rods through a different one of the corresponding grooves.

Each chair arm extension may be configured to detachably connect to each pair of the chair leg. The pair of chair arm extensions towards the back of the chair may be configured to detachably connect to only the pair of chair legs towards the back of the chair and the pair of chair arm extensions towards the front of the chair may be configured to detachably connect only to the pair of chair legs towards the front of the chair. The chair arms, chair arm extensions, and chair legs may include one of steel, iron, and aluminum. Each of the chair arms and chair legs may be hollow. The legs of each pair of the chair legs may be connected to one another by a different supporting rod.

BRIEF DESCRIPTION OF THE DRAWINGS

Exemplary embodiments of the invention can be understood in more detail from the following descriptions taken in conjunction with the accompanying drawings in which.

DETAILED DESCRIPTION OF THE EXEMPLARY EMBODIMENTS

Exemplary embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
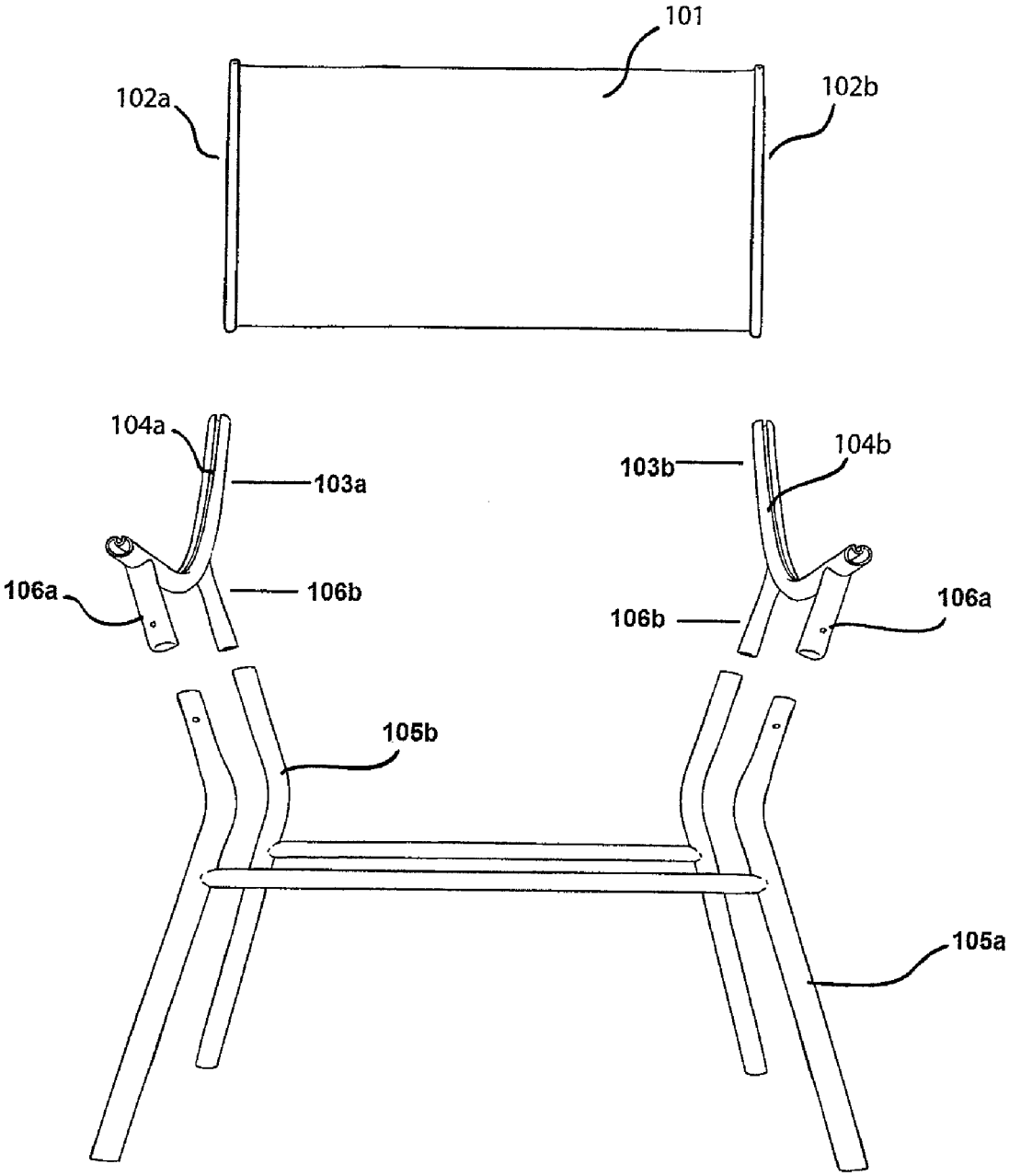
FIG. 1 illustrates an exploded view of a chair according an exemplary embodiment of the present invention.

FIG. 1 illustrates an exploded view of a chair according to an exemplary embodiment of the present invention. Referring to FIG. 1, the chair includes a sheet of fabric 101, a pair of chair arms 103*a* and 103*b*, and a pair of leg sections 105*a* and 105*b*. The chair arms 103*a* and 103*b* and leg sections 105*a* and 105*b* are preferably made of metal. For example, the chair arms 103*a* and 103*b* and leg sections 105*a* and 105*b* may be made of aluminum, steel, iron, etc.

The sheet of fabric 101 may made out of elastic materials such as polyester, vinyl coated polyester, spandex, etc. A portion of the left and right edges of the sheet of fabric 101 are wrapped around the length of rods 102*a* and 102*b*. The rods 102*a* and 102*b* may be made out flexible materials such as plastic, hard rubber, etc. The wrapped portions are of sufficient area to cover the rods 102*a* and 102*b*. The wrapped portions may be secured to the rods 102*a* and 102*b* by wrapping them tightly around the respective rods 102*a* and 102*b* and stitching them to an edge of the fabric 101. Each rod 102*a* and 103*b* is preferably affixed substantially parallel to one another on the fabric 101.

Figure 2:
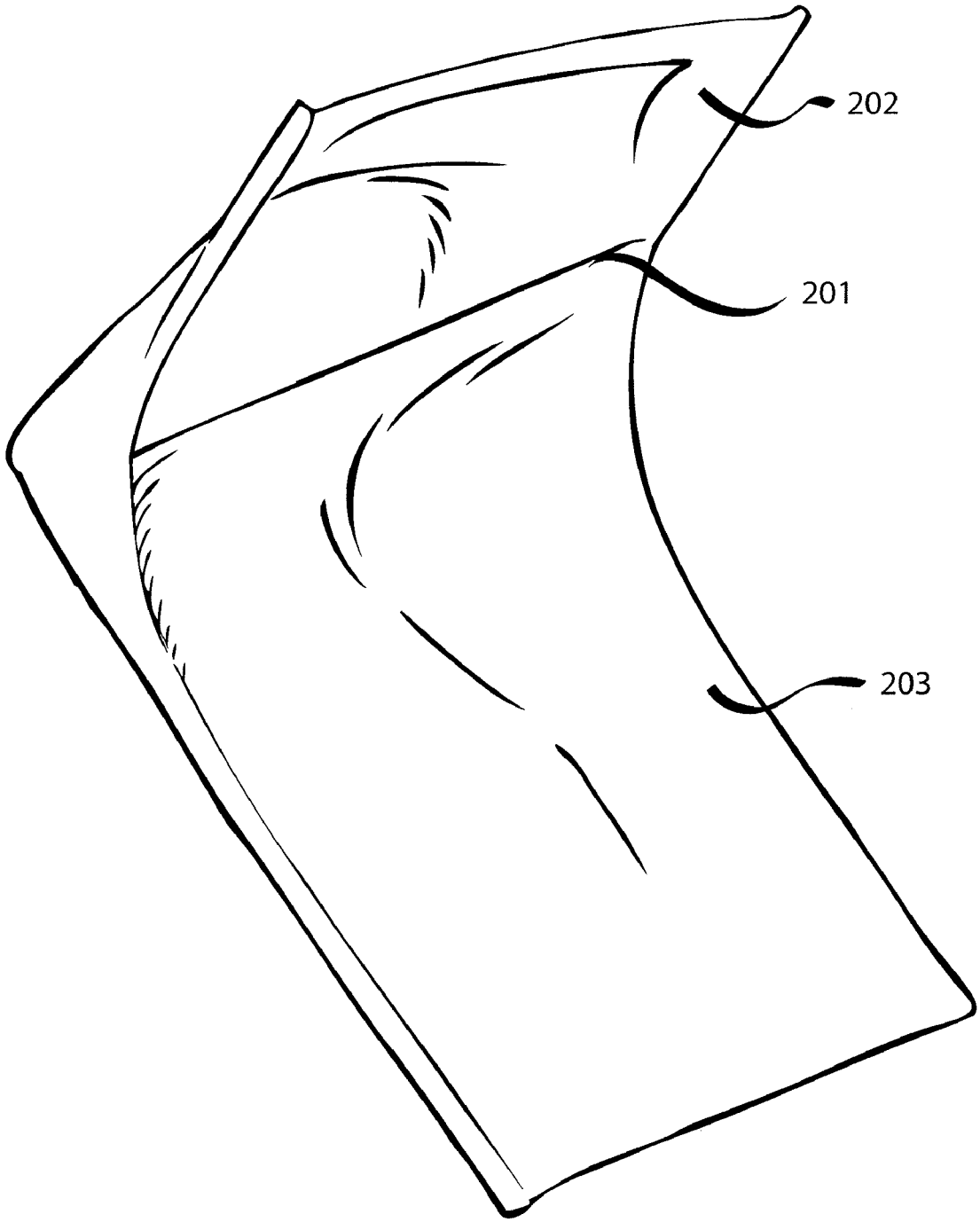
FIG. 2 illustrates an exemplary embodiment of a sheet of fabric that may be attached to the chair of FIG. 1.

The chair arms 103*a* and 103*b* and leg sections 105*a* and 105*b* may be made out of a metal such as steel, iron, aluminum, etc. The chair arms 103*a* and 103*b* have a concave curved shape and include respective grooves 104*a* and 104*b*. The grooves 104*a* and 104*b* extend end-to-end along the top of each of the chair arms 103*a* and 103*b*. The grooves 104*a* and 104*b* preferably have an equal-depth along the length of each of the chair arms 103*a* and 103*b*. The chair arms 103*a* and 103*b* may be formed from a cylindrical hollow metal tube, which may be bent into a concave curve. An lower portion of each chair arm 103*a/b* may be substantially straight, while an upper portion of each chair arm may be substantially concave. The grooves 104*a* and 104*b* in the chair arms 103*a* and 103*b* may be formed by bending a portion of the length of the cylindrical tube inward to form a groove. The sheet of fabric 101 may be attached to the chair by threading the attached rods 102*a* and 102*b* through the groves 104*a* and 104*b*. The sheet of fabric 101 may be stitched to separate the sheet into a backing portion and a seat portion. FIG. 2 illustrates an exemplary embodiment of the sheet of fabric 101 with a stitching 201 that separates the sheet of fabric 101 into the backing portion 202 and the seat portion 203.

Referring to FIG. 1, the chair arms 103*a* and 103*b* include a pair of front arm extensions 106*a* and a pair of back arm extensions 106*b*. A front arm extension 106*a* is connected to the bottom of each of the chair arms 103*a* and 103*b* towards the front of the chair. A back arm extension 106*b* is connected to the bottom of each of the chair arms 103*a* and 103*b* towards the rear of the chair. The extensions 106*a* and 106*b* may be connected to the respective chair arms 103*a* and 103*b* by soldering. The length of the front arm extensions 106*a* may be sized to differ with the length of the back arm extensions 106*b*. It is preferred that the length of the back arm extensions 106*b* be longer than the length of the front arm extensions 106*a*.

Figure 3:
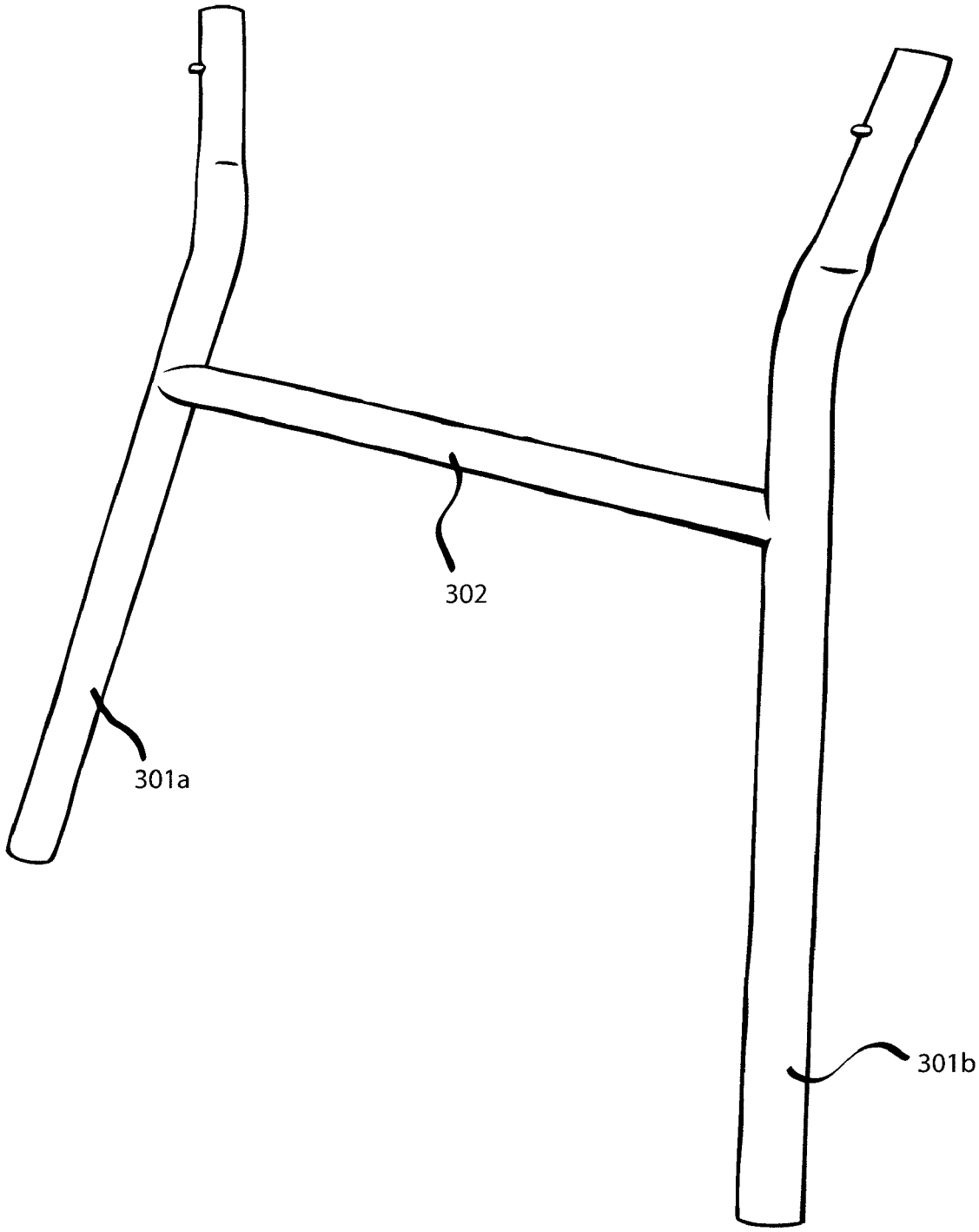
FIG. 3 illustrates an exemplary embodiment of a front leg section of FIG. 1.

The front leg section 105*a* includes a pair of front legs connected by a front supporting rod. FIG. 3 illustrates an exemplary embodiment of the front leg section 105*a*. Referring to FIG. 3, a lower portion of each front leg 301*a* and 301*b* may be substantially straight, while an upper portion of each front leg 301*a* and 301*b* may be somewhat curved. The front supporting rod 302 may be connected between the lower and upper portion of each front leg 301*a* and 301*b*.

Figure 4:
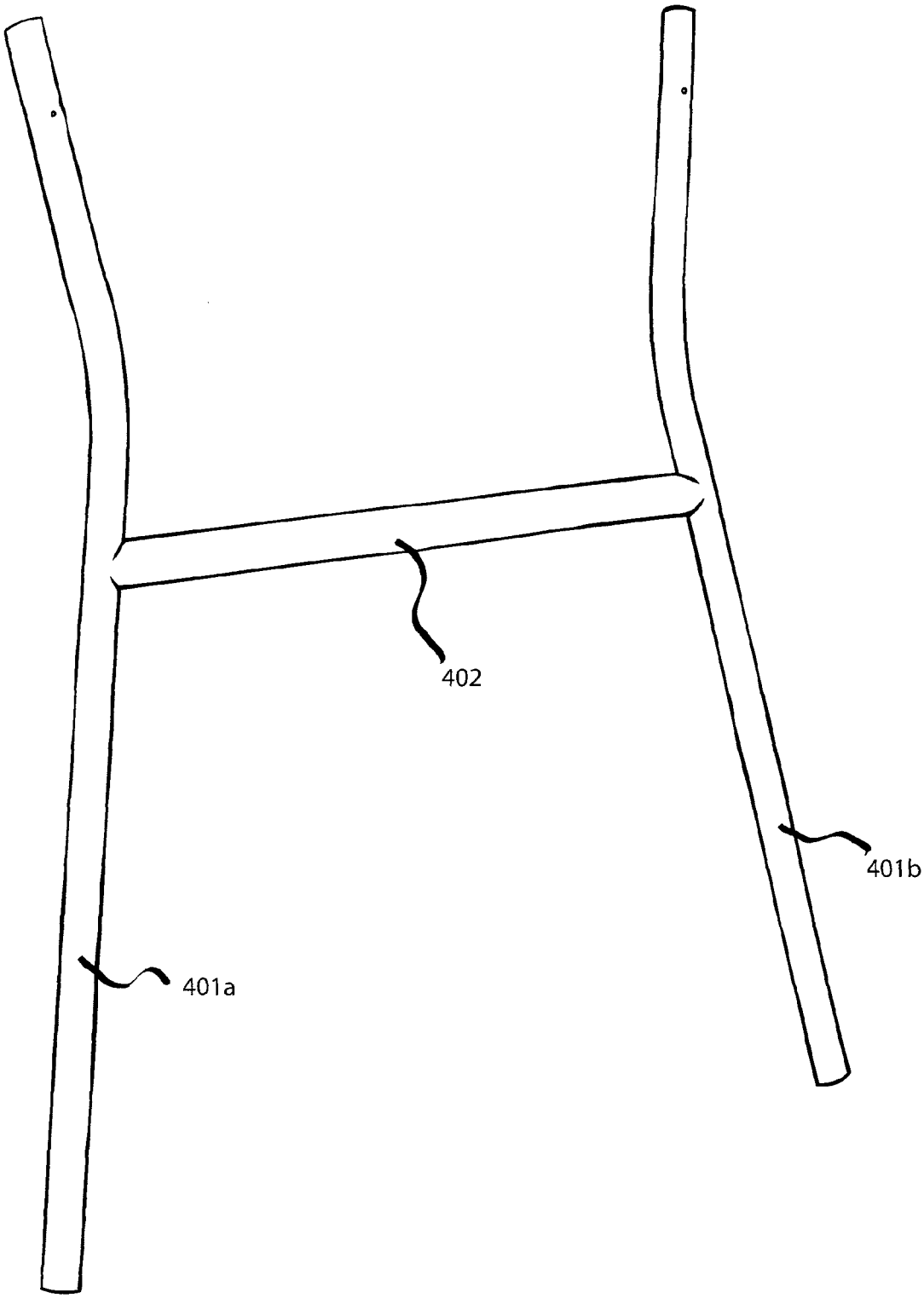
FIG. 4 illustrates an exemplary embodiment of a back leg section of FIG. 1.
Figure 5:
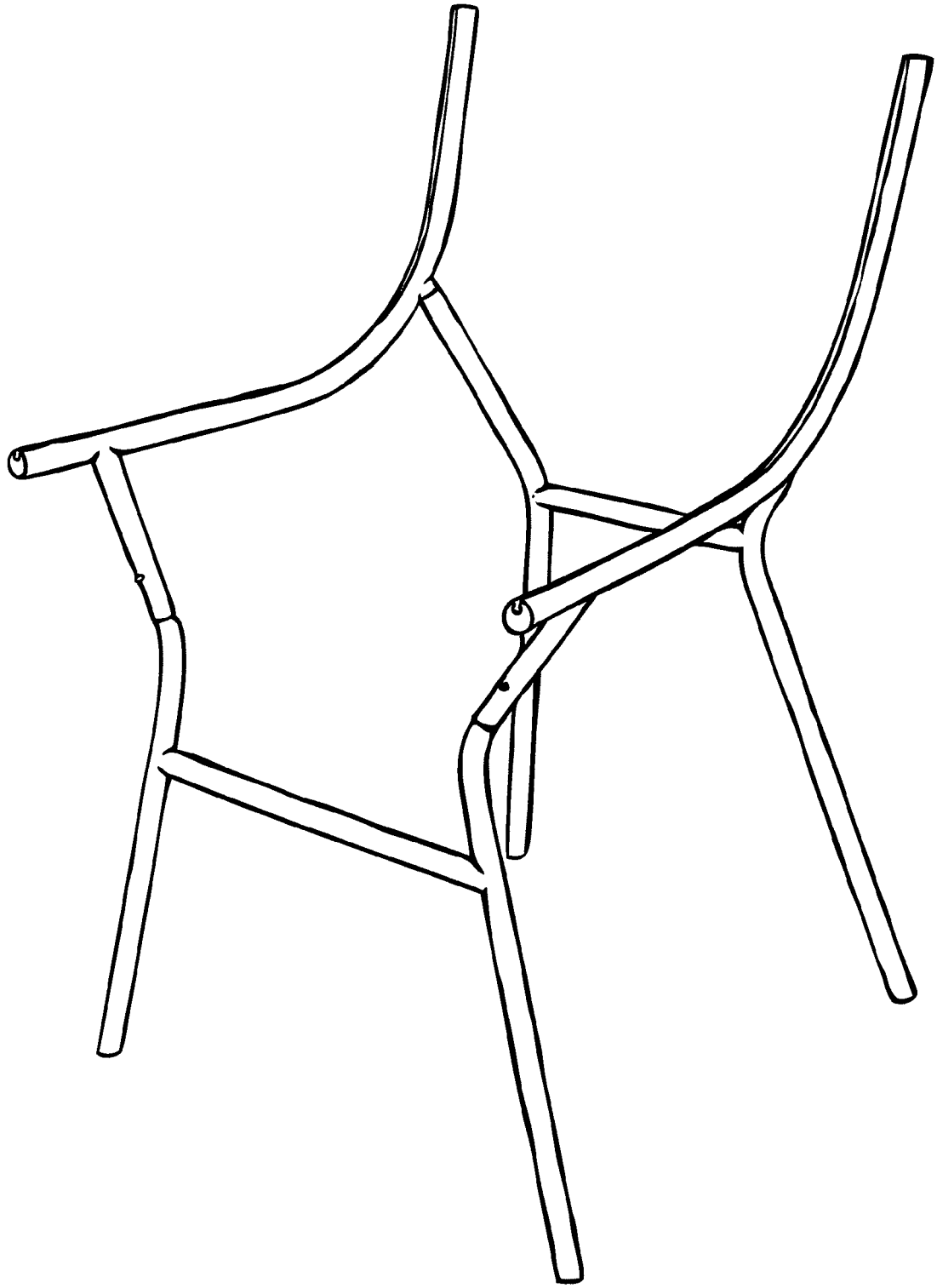
FIG. 5 illustrates an exemplary embodiment of a chair according to an exemplary embodiment of the present invention.

The back leg section 105*b* includes a pair of back legs connected by a back supporting rod. FIG. 4 illustrates an exemplary embodiment of the back leg section 105*b*. Referring to FIG. 4, a lower portion of each back leg 401*a* and 401*b* may be substantially straight, while an upper portion of each back leg 401*a* and 401*b* may be somewhat curved. The back supporting rod 402 may be connected between the lower and upper portion of each back leg 401*a* and 401*b*.

The supporting rods 302 and 402 may be connected to their respective legs by soldering. The front legs 301*a* and 301*b*, back legs 401*a* and 401*b*, and supporting rods 302 and 402 may be hollow. The length of the upper portion of the front legs 301*a* and 301*b* may differ from the length of the upper portion of the back legs 401*a* and 301*b*. It is preferred that the length of the upper portion of the front legs 301*a* and 301*b* be smaller than the length of the upper portion of the back legs 401A and 401B.

Referring to FIG. 1, a chair may be constructed by first attaching the arms 103*a* and 103*b* to the leg sections 105*a* and 105*b*, and then attaching the sheet of fabric 101 to the chair arms 103*a* and 103*b*. The chair arms 103*a* and 103*b* may be substantially parallel to one another. The chair arms 103*a* and 103*b* are connected to the chair leg sections 105*a* and 105*b* via the arm extensions 106*a* and 106*b*. For example, the front arm extensions 106*a* may be inserted into openings in the front leg section 105*a* and the back arm extensions 106*b* may be inserted into openings in the back leg sections 105*b*.

Figure 6:
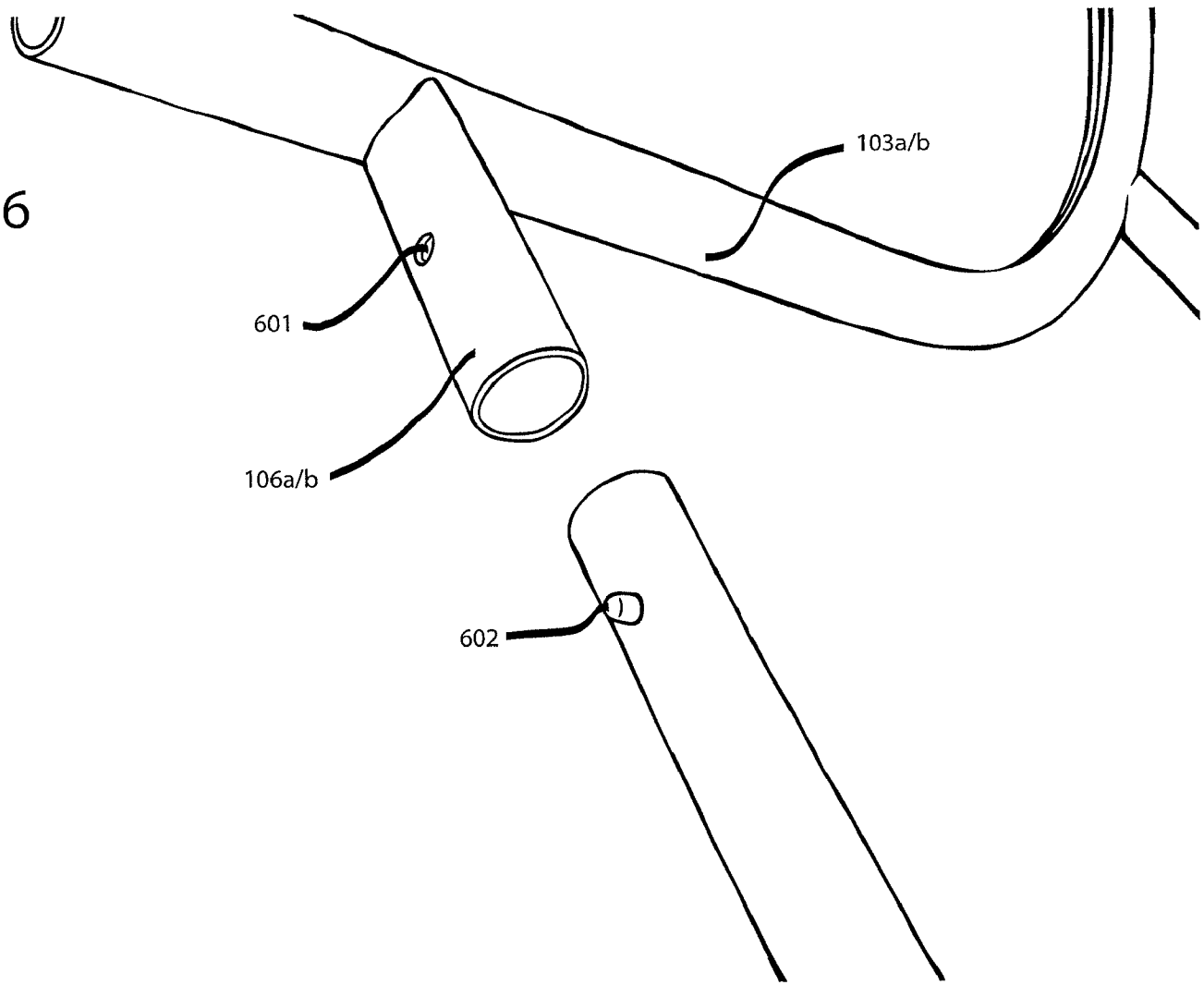
FIG. 6 illustrates a detachable chair arm and leg of a chair according to an exemplary embodiment of the present invention.

The chair arms 103*a* and 103*b* may connected to the leg sections 105*a* and 105*b* permanently, for example by soldering. However, it is preferred that the chair arms 103*a* and 103*b* be detachable from the leg sections 105*a* and 105*b* to make shipping/transporting easier and to allow the chair to be more efficiently stored. FIG. 6 illustrates a chair arm 103*a/b* that is detachable from a chair leg section 105*a/b* according to an exemplary embodiment of the present invention. Referring to FIG. 6, the chair arm extension 106*a/b* of the chair arm 103*a/b* includes a hole 601. The upper portion of the leg section 105*a/b* includes a button 602, which interlocks with the hole 601 of the chair arm extension 106*a/b*. An internal spring mechanism (not shown) keeps the button 602 engaged. The diameter of the arm extension 106*a/b* is slightly smaller than the diameter of the upper portion of the leg section

105*a/b* to enable the arm extension 106*a/b* to be securely fitted into the upper portion of the leg section 105*a/b* when the button 602 is depressed. Alternately, the diameter of the arm extension 106*a/b* can be formed to be slightly larger than the diameter of the upper portion of the leg section 105*a/b* with the hole 601 being disposed in the arm extension 106*a/b* and the button 602 being disposed in the upper section of the leg section 105*a/b* to enable the leg section 105*a/b* to be securely fitted into the arm extension 106*a/b* when the button 602 is depressed.

In an alternate embodiment of the present invention, each leg of a first one of the leg sections (e.g., 105*a*) has the button and each leg of the second leg section (e.g., 105*b*) has the hole. In this embodiment, each arm extension of the first pair of chair arm extensions (e.g., 106*a*) has the hole and each arm extension of the second pair of chair arm extensions (e.g., 106*b*) includes the button. For example, the back chair arm extensions 106*b* can be configured to detachably connect to only the back leg section 105*b* and the front chair arm extensions 106*a* can be configured to detachably connect to only the front leg section 105*a*, thereby reducing or preventing the possibility of incorrect assembly of the chair.

In an alternate embodiment of the present invention, each of the chair arms 103*a/b* is formed together with a front leg 301*a/b* and a back leg 401*a/b* of each of the leg sections 105*a/b* as two single contiguous pieces. FIG. 4 illustrates a further embodiment of the present invention, where the two contiguous pieces are permanently connected together via front and back supporting rods. Alternately, the supporting rods may be detachably connected to each of the two contiguous pieces by use of the same spring locked buttons discussed above.

Figure 7:
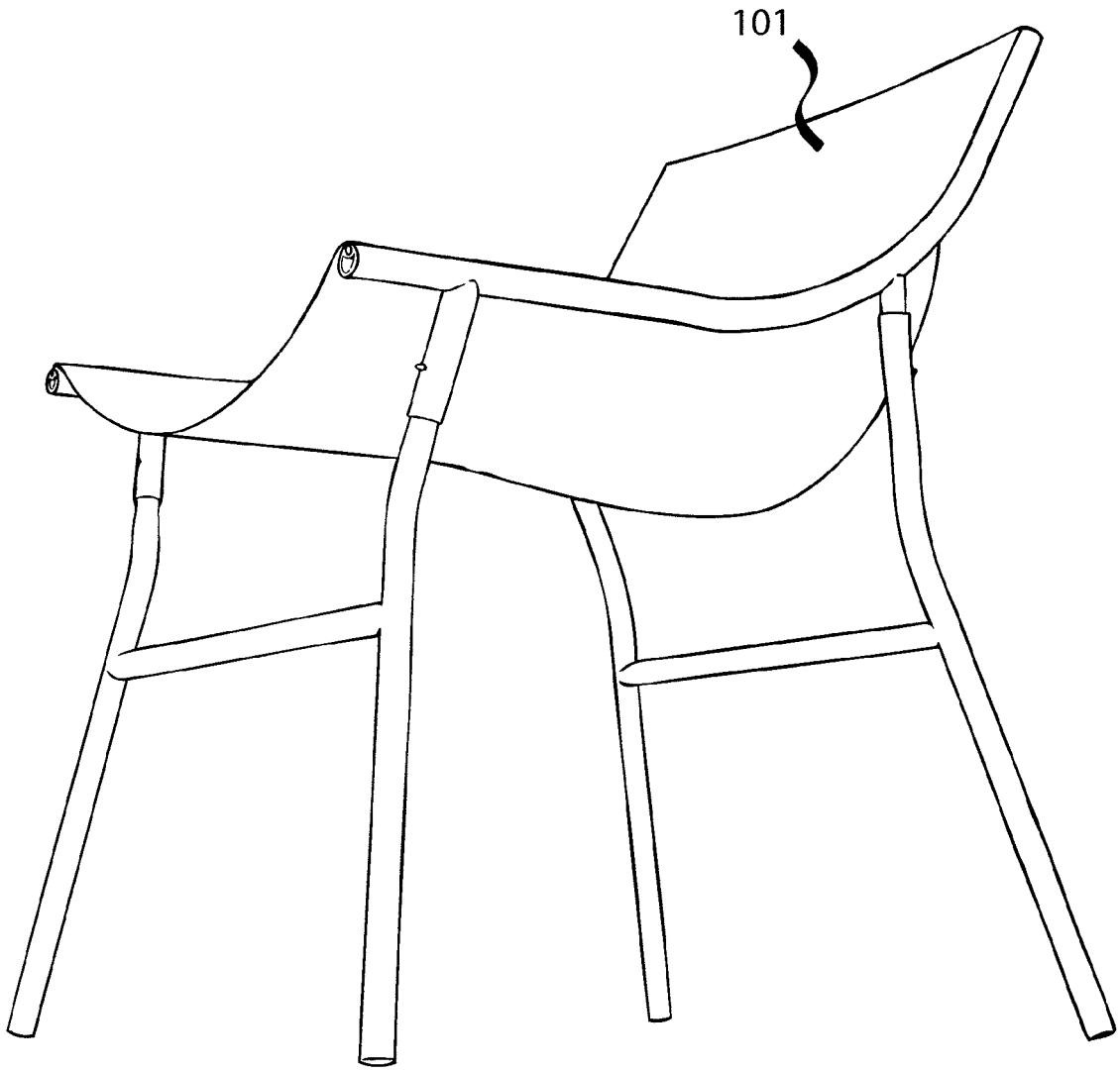
FIG. 7 illustrates a completed view of chair according to an exemplary embodiment of the present invention.

The sheet of fabric 101 can then be attached to the chair arms 103*a* and 103*b* by threading the rods 102*a* and 102*b* of the sheet through the grooves 104*a* and 104*b* in the respective chair arms 103*a* and 103*b*. FIG. 7 illustrates a completed chair according to an exemplary embodiment of the present invention. Referring to FIG. 7, when a user sits on the sheet of fabric 101, the sheet of fabric 101 will stretch downward based on the weight of the occupant, the width of the sheet, and the type of material used in the fabric. The width of the material should be configured such that an occupant rests lower than the chair arms 103*a* and 103*b*, but above the supporting rods of the leg sections 105*a* and 105*b*.

In a completed chair according to an exemplary embodiment of the present invention, each of the front legs are separated from one another by a distance that ranges between about 18 and 30 inches, each of backs legs are separated from one another by the same distance, the front leg section is separated by the same distance from back leg section, and the height of the completed chair ranges between 32 and 44 inches. However, the present invention is not limited to the above provided dimensions. For example, the distances between legs, distances between leg sections, and lengths of legs and arms may vary considerably or be proportionally scaled up or down as desired.

Figure 8:
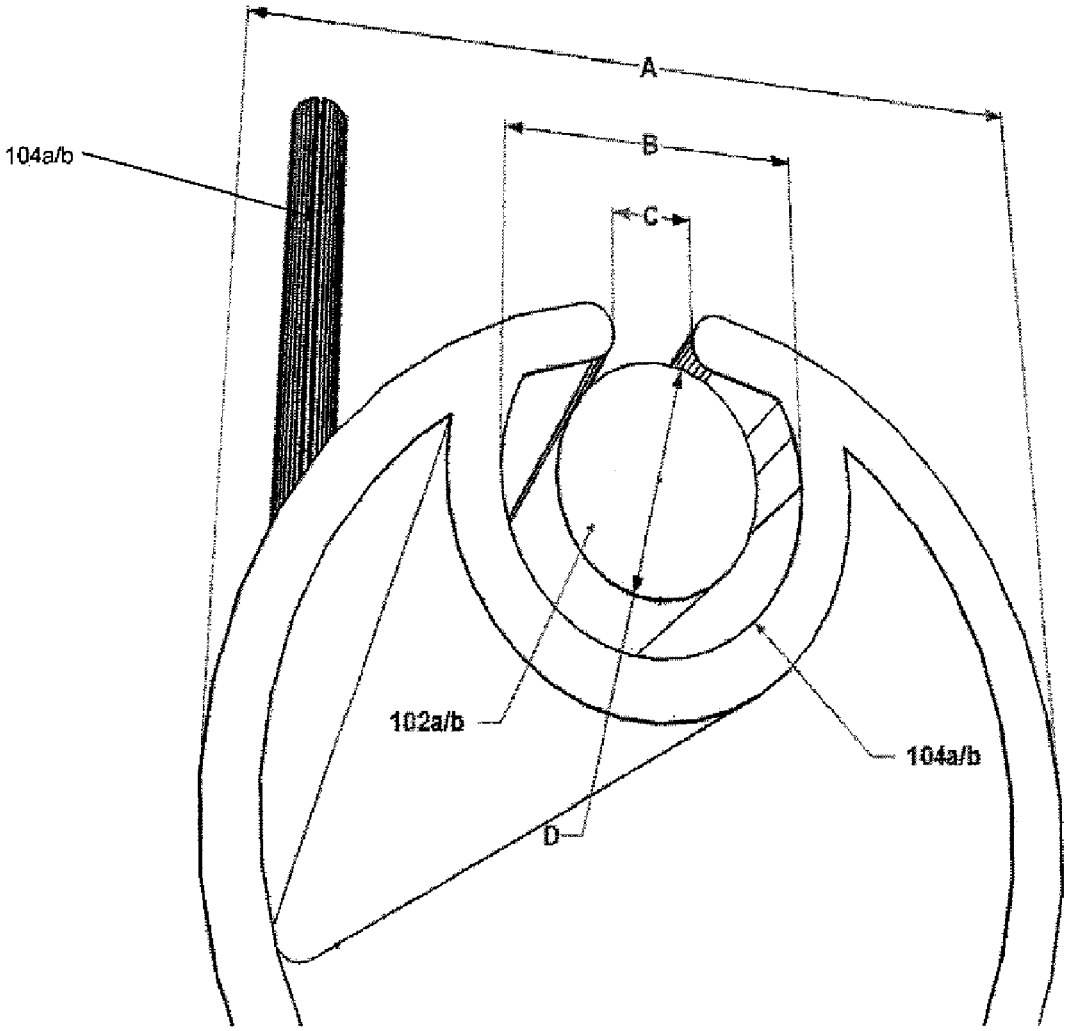
FIG. 8 illustrates a blown up view of a chair arm of FIG. 1.

FIG. 8 illustrates a blown up view of one of the chair arms 103*a* and 103*b* of FIG. 1, according to an exemplary embodiment of the present invention. Referring to FIG. 8, each end of the chair arms 103*a* and 103*b* may be substantially circular. The diameter D of each of the rods 102*a* and 102*b* is larger than a width C of a top opening in the grooves 104*a* and 104*b*. Each of the grooves 104*a* and 104*b* may be substantially circular. The diameter D of the rods 102*a* and 102*b* may be about ¼ of an inch, the width C of each opening may be about ⅛ of an inch, the diameter B of the groves 104*a* and 104*b* may be about ⅜ of an inch, and the diameter A of each end of the chair arms 103*a* and 103*b* may be about 1 inch. However, the present invention is not limited to these dimensions. For example, the above provided diameters and/or widths may be varied considerably and be proportionally scaled up or down as is desired.

Figure 9:
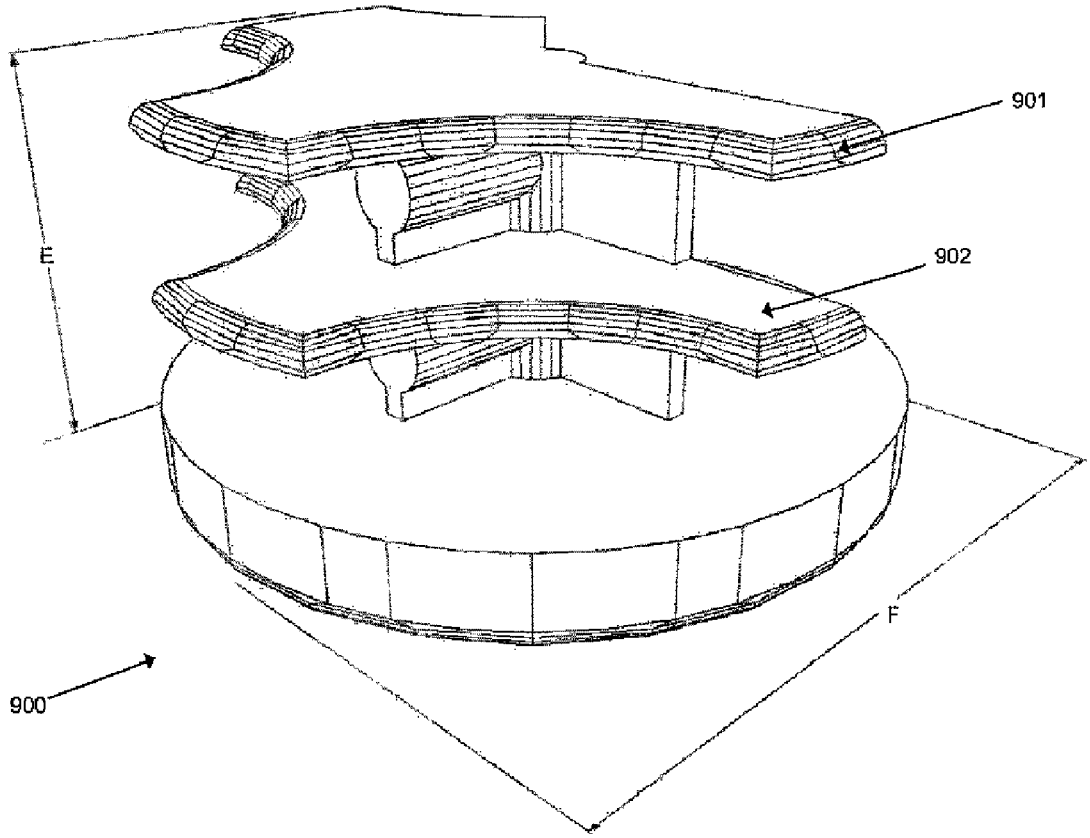
FIG. 9 illustrates an exemplary embodiment of a cap that may be fitted in and end of the chair arm of FIG. 8.

Caps may be inserted into the ends of the chair arms 103*a* and 103*b* to prevent the sheet of fabric 101 from sliding out of the grooves 104*a* and 104*b*. FIG. 9 illustrates an embodiment of a cap that may be inserted into a chair arm 103*a/b* of a chair according to exemplary embodiment of the present invention. Referring to FIG. 9, the cap 900 includes layers 901 and 902 that are formed with a concave shape to match the concavity of the bottom of a groove 104*a/b* at the end of a chair arm, such as one illustrated in FIG. 8. The cap 900 may be fitted below the groove into the end of each chair arm. Although the cap 900 is illustrated in FIG. 9 as having two layers 901 and 902 separated by a gap in between, the layers may be combined into a single layer, or the cap 900 may have more than two layers. The cap 900 may be made out of material such as plastic or rubber. In one embodiment, the height E of the cap 900 is about a half inch and the diameter F of the cap 900 matches that of a chair arm end (e.g., approximately 1 inch). However, the present invention is not limited to these dimensions. For example, the dimensions of the cap 900 may vary considerably and be proportionally scaled up or down as is needed.

Although illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention.

What is claimed is:

1. A chair comprising:

a pair of chair arms, each chair arm having a concave shape and a concave groove extending along the entire length of a concave top surface of the chair arm, wherein each chair arm includes a pair of extensions;

two pairs of chair legs; and a sheet of fabric having a pair of flexible rods, each rod affixed to the fabric and substantially in parallel to one another, wherein the sheet of fabric is affixed to the chair by threading each of the rods through a different one of the corresponding grooves, wherein each extension extends downward from a corresponding one of the chair arms and is inserted into a corresponding one of the chair legs.

2. The chair of claim 1, wherein the chair legs and chair arms comprise metal.

3. The chair of claim 2, wherein each chair arm and chair leg is a hollow tube.

4. The chair of claim 1, wherein the depth of each groove along the entire length of each arm is substantially the same.

5. The chair of claim 1, wherein the fabric comprises an elastic material.

6. The chair of claim 1, wherein the sheet of fabric is stitched to separate the sheet into a chair backing section and a chair seat section.

7. A chair comprising:

a pair of chair arms, each chair arm having a concave shape and a concave groove extending along the entire length of a concave top surface of the chair arm;

two pairs of chair legs, each pair of chair legs being affixed to a bottom surface of each chair arm; and a sheet of fabric having a pair of flexible rods, each rod affixed to the fabric and substantially in parallel to one another, wherein the sheet of fabric is affixed to the chair by threading each of the rods through a different one of the corresponding grooves, wherein each of the chair arms includes a pair of chair arm extensions that are configured to detachably connect to each pair of the chair legs, and wherein each chair arm extension is detachably connected to each chair leg using a button, and the button is attached to an end of one of the chair arm extension and the chair leg, and an end of the other of the chair arm extension and the chair leg includes a hole for receiving the button.

8. A chair comprising:

a pair of chair arms, each chair arm having a concave shape and a concave groove extending along the entire length of a concave top surface of the chair arm;

two pairs of chair legs, each pair of chair legs being affixed to a bottom surface of each chair arm; and a sheet of fabric having a pair of flexible rods, each rod affixed to the fabric and substantially in parallel to one another, wherein the sheet of fabric is affixed to the chair by threading each of the rods through a different one of the corresponding grooves, wherein the chair legs of each pair of chair legs are connected to one another by a supporting rod, and wherein the width of the fabric is configured such that an occupant of the chair rests lower than the chair arms and higher than the supporting rods.

9. The chair of claim 8, wherein each supporting rod is detachably connected to its respective legs.

10. The chair of claim 1, further comprising a plurality of caps, wherein each cap includes a layer with a concave shape that is configured to fit into each chair arm end below the corresponding groove.

11. The chair of claim 1, wherein the chair arms are substantially parallel to one another.

12. The chair of claim 1, wherein the diameter of each rod is larger than the width of each groove.

13. A chair comprising:

a pair of chair arms, each chair arm having an upper concave portion and a lower substantially straight portion, each chair arm having a substantially equal-depth groove extending along an upper surface of the chair arm;

two pairs of chair arm extensions, each chair arm extension of the first pair affixed to a bottom surface of a different chair arm in the upper concave portion, each chair arm extension of the second pair affixed to a bottom surface of a different chair arm in the lower substantially straight portion, wherein each chair arm extension extends downward from the chair arms;

two pairs of chair legs, one pair of the chair legs affixed to a first pair of the chair arm extensions and a second pair of the chair legs attached to the other pair of chair arm extensions, wherein each chair arm extension fits into a corresponding one of the legs;

a sheet of elastic fabric; and a pair of flexible rods, each rod affixed to the fabric and substantially in parallel to one another, wherein the sheet of fabric is affixed to the chair by threading each of the rods through a different one of the corresponding grooves.

14. The chair of claim 13, wherein each chair arm extension is configured to detachably connect to each pair of the chair leg.

15. The chair of claim 14, wherein the pair of chair arm extensions towards the back of the chair are configured to detachably connect only to the pair of chair legs towards the back of the chair and the pair of chair arm extensions towards the front of the chair are configured to detachably connect only to the pair of chair legs towards the front of the chair.

16. The chair of claim 13, wherein the chair arms, extensions, and chair legs comprise one of steel, iron, and aluminum.

17. The chair of claim 13, wherein each of the chair arms and chair legs are hollow.

18. The chair of claim 13, wherein the legs of each pair of the chair legs are connected to one another by a different supporting rod.

* * * * *